United States Patent [19]

Hebert

[11] Patent Number: 4,478,528

[45] Date of Patent: Oct. 23, 1984

[54] WIRE MATRIX PRINT HEAD ASSEMBLY

[75] Inventor: Donald G. Hebert, 9412 Cherry Hills La., San Ramon, Calif. 94583

[73] Assignees: Donald G. Hebert; Helmut Falk, both of Sunnyvale, Calif.

[21] Appl. No.: 78,289

[22] Filed: Sep. 24, 1979

Related U.S. Application Data

[63] Continuation-in-part of Ser. No. 885,186, Mar. 10, 1978, Pat. No. 4,185,929, and Ser. No. 887,927, Mar. 17, 1978, Pat. No. 4,230,412.

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 4,117,435 9/1978 Hishida et al. ..... 400/124 X 4,222,674 9/1980 Mori et al. ..... 400/124

*Primary Examiner*—Paul T. Sewell

*Attorney, Agent, or Firm*—Klaas & Law

[57] ABSTRACT

A wire matrix print head assembly in which the print wires are operably supported in one-piece bearing and guide passage block member in an elongated wire housing with wire actuating armature members arranged in a circular array between radially innermost and outermost poles of electromagnetic armature actuating devices and an armature retaining cover member centrally adjustably connected to the wire housing and having armature confining slots holding the armatures in pivotally displaceable operable association with the poles, the armatures being pivotally supported on the radially outermost edge surfaces of the outermost poles with or without resilient biasing devices continuously holding the armatures in engagement with the pole pivot surfaces without applying a moment of force and peripheral portions of the cover member being mounted in rigid abutting engagement with end surfaces of the outermost poles.

20 Claims, 10 Drawing Figures

Fig-1
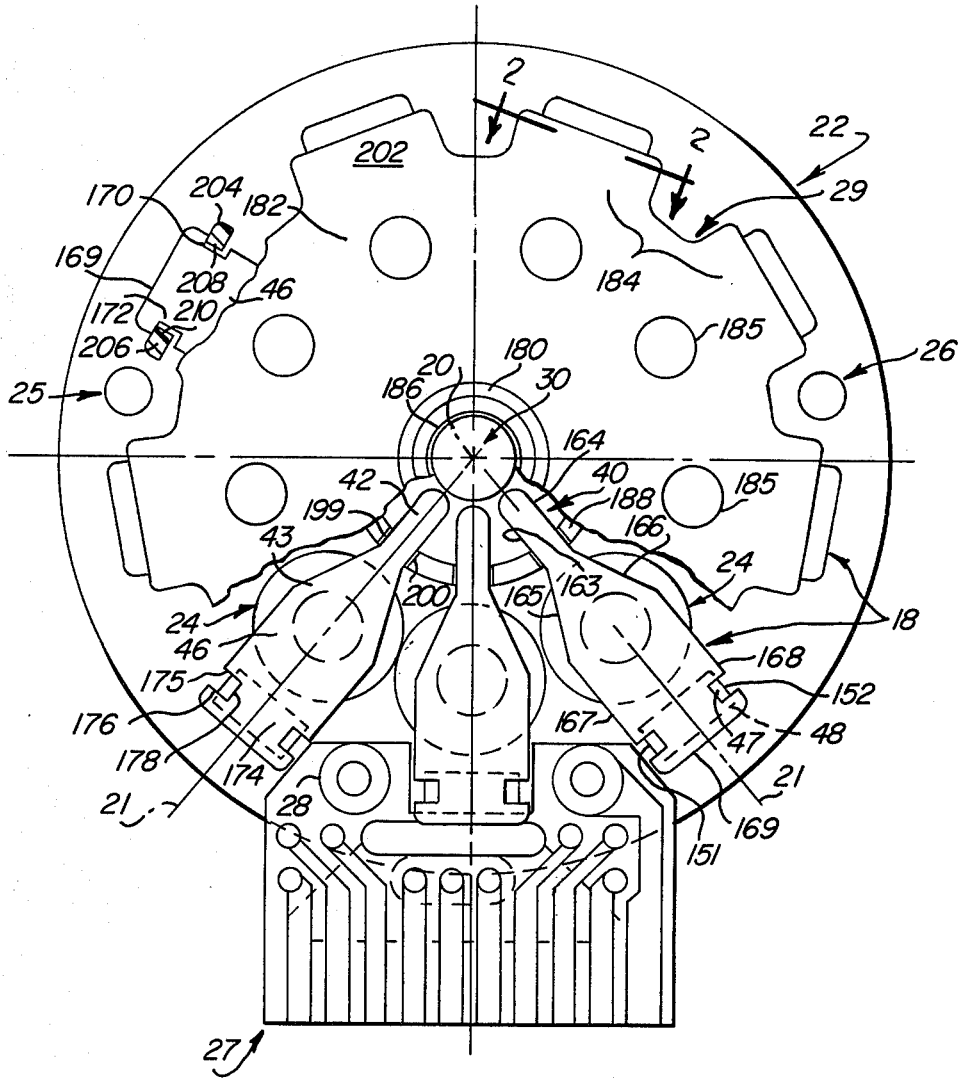
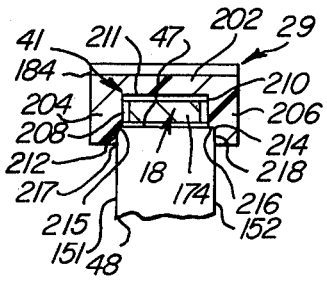
Fig-2

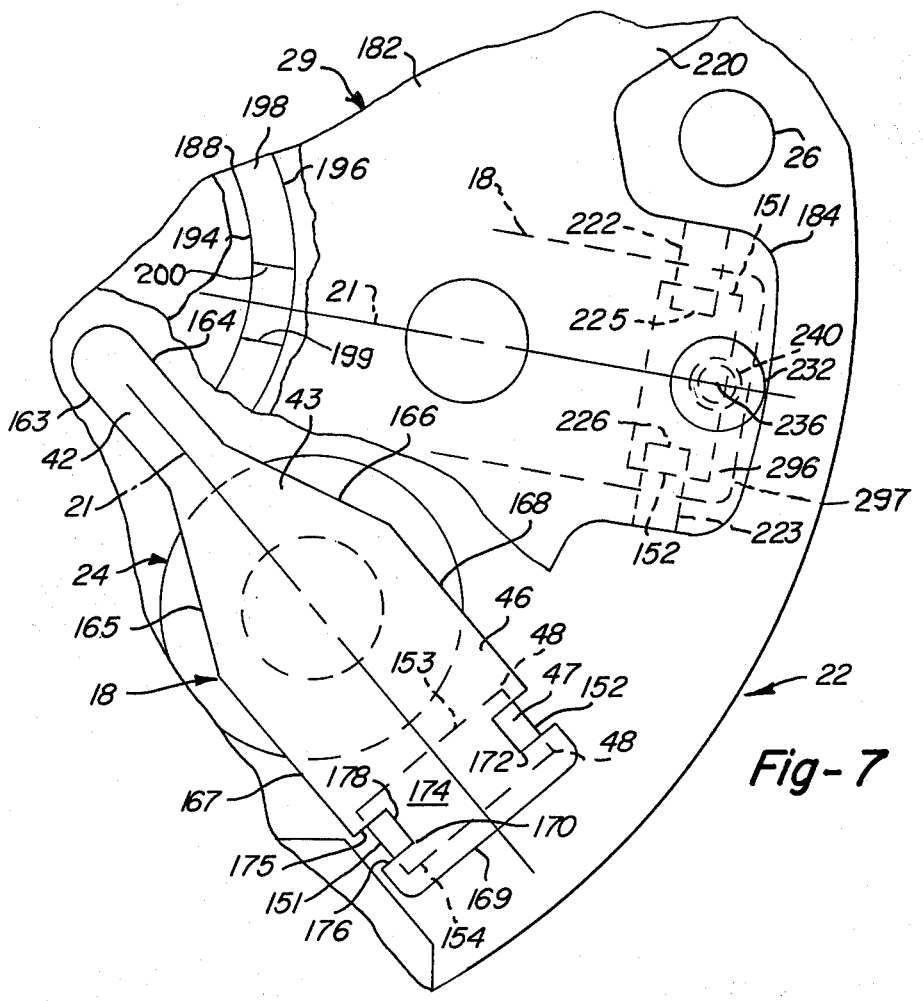
Fig-7
Fig-8
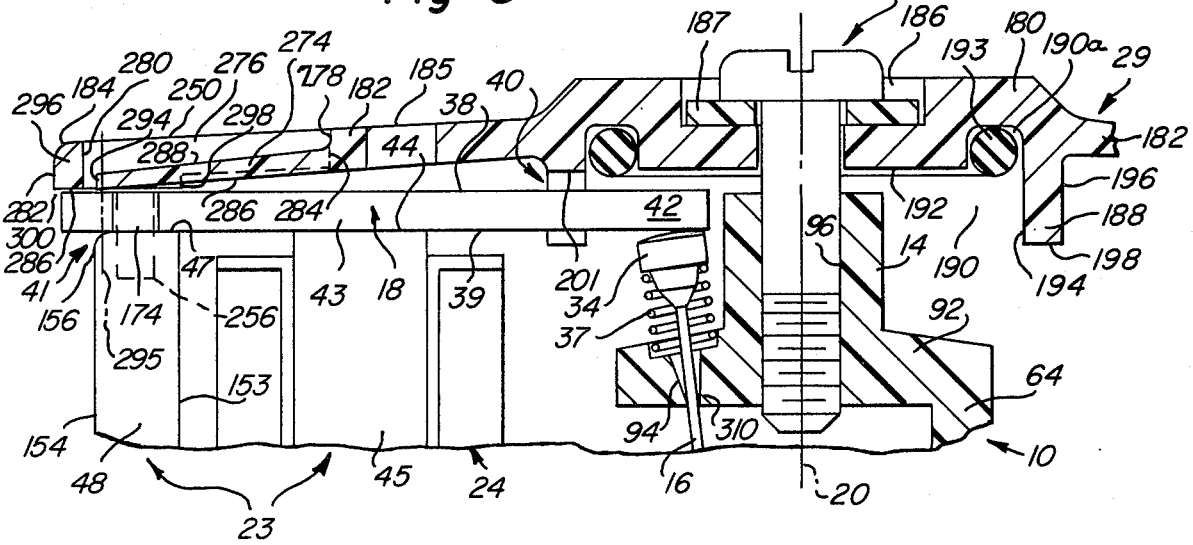

WIRE MATRIX PRINT HEAD ASSEMBLY

This application is a continuation-in-part of my prior copending U.S. patent application Ser. No. 885,186 filed Mar. 10, 1978, now U.S. Pat. No. 4,185,929, for Wire Matrix Print Head Assembly, and of my prior copending U.S. patent application Ser. No. 887,927, filed Mar. 17, 1978, now U.S. Pat. No. 4,230,412 for Matrix Print Head Assembly the disclosures of which are also specifically incorporated herein by reference.

BACKGROUND AND SUMMARY OF THE INVENTION

This invention relates to a matrix print head assembly of the general type disclosed in my prior U.S. Pat. No. 4,051,941, the disclosure of which is specifically incorporated herein by reference.

As disclosed in my prior U.S. Pat. Nos. 3,929,214, 3,994,381, and 4,051,941, various prior art armature retainer designs have been constructed and arranged to provide a spring means adapted to engage the radially outer end portion of the armature radially outwardly of the pivot on the outer edge of the outer pole for the stated purposes of (1) establishing a substantial moment of force on the armature causing pivotal movement toward the non-print position when the coil is de-energized, (2) maintaining the armature in engagement with the outer pole to insure a proper magnetic flux path therebetween, and (3) providing an adjustable reference armature abutment surface or surfaces by which the air gaps between the armatures and the inner pole may be more or less uniformly controlled.

A disadvantage of such prior arrangements is that the moment of force exerted by the spring means on the outer end of the armature opposes the wire driving movement of the armature from the non-print position toward the print position. In addition, the moment of force increases during such movement. As a result, the frequency response of the armature is reduced. I have discovered that provision of such a moment of force is not only undesireable but also unnecessary with use of the construction and arrangement of the present invention. Furthermore, by use of the present invention it is not necessary to maintain the armature in contact with the pole pivot for the purpose of insuring a proper magnetic flux path therebetween although it is possible if desireable to provide light force holding means, engageable with the armature directly opposite the pole pivot so as to eliminate the prior art moment of force, for the purpose of reducing armature vibration with reduction of resulting wear and noise in operation. The desired uniformity of the air gaps between the armatures and their associated inner pole portions is maintained in the present invention by a construction and arrangement wherein an armature retaining cover means has (1) axially facing pole abutment surfaces located in a common radially plane substantially coplanar with pole end surfaces also located in a common radially plane, (2) precisely located armature confining surfaces on the armature retaining cover means to define, in conjunction with the pole end surfaces, relatively precisely dimensioned and located armature confining slot means. In the presently preferred embodiment, the pole end surfaces are lightly ground after assembly to establish the desired coplanar relationship and the side surfaces of the armatures are also ground prior to assembly to assure parallelism between those surfaces.

An object of the present invention is to provide new and improved armature retainer means for retaining the armatures of a matrix print head assembly solely by pivotally supporting the outer end portions of the armatures on the outer edges of the outer poles and closely but loosely confining a narrow length portion of the armatures by confining slot means defined by an axially extending rim portion of the retainer plate which rigidly abuts the outer pole, with or without use of any resilient armature biasing means, and with the inner end portions of the armatures being located in the non-print position only by the spring biased wire drive heads. If a resilient armature biasing means is used, it engages the armature directly opposite the pole pivot with a low spring force sufficient only to lightly hold the armature on the pivot without application of any moment of force opposing the movement of the armature from the non-print position to the print position. The resilient armature biasing means are in the form of individual compression springs mounted in the retainer plate or individual integral tongue portions or individual integral bearing rib portions. Dampening means may be provided opposite both the radially innermost and radially outermost portions of the armature.

Another object is to provide new and improved wire guide means for guiding the wires by use of only one elongated guide end bearing member centrally mounted in the wire housing cavity and only one end bearing member mounted on the end wall of the wire housing with wire guide means integrally formed in the end wall of the wire housing axially adjacent the end bearing member.

Another object is to provide new and improved pole mounting means for mounting the pole members on the pole support plate by press fitting an enlarged base portion of the pole members into smaller size openings in the pole support plate defined by an annular rib and opposite enlarged counter bores causing flow of pole member material around the annular rib and into the counterbore to form a locking annular groove about the annular rib.

Other objects and advantages of the present invention are reduction of number of parts, reduction of cost of manufacture, elimination of adjustment devices, elimination of parts subject to wear and replacement, simplification assembly, and repair and replacement of parts.

BRIEF DESCRIPTION OF DRAWING

Illustrative and presently preferred embodiments of the invention are shown in the accompanying drawing in which:

FIG. 1 is an end view of one embodiment of a print head assembly of the present invention with parts of the cover plate broken away;

FIG. 2 is a cross-sectional view of a portion of the assembly of FIG. 1 taken along line 2—2 therein;

FIG. 7 is a partial end view of the assembly of FIG. 6 with parts of the cover plate broken away;

FIG. 8 is a cross-sectional view of a portion of still another embodiment of a print head assembly of the present invention;

DETAILED DESCRIPTION

Figure 3:
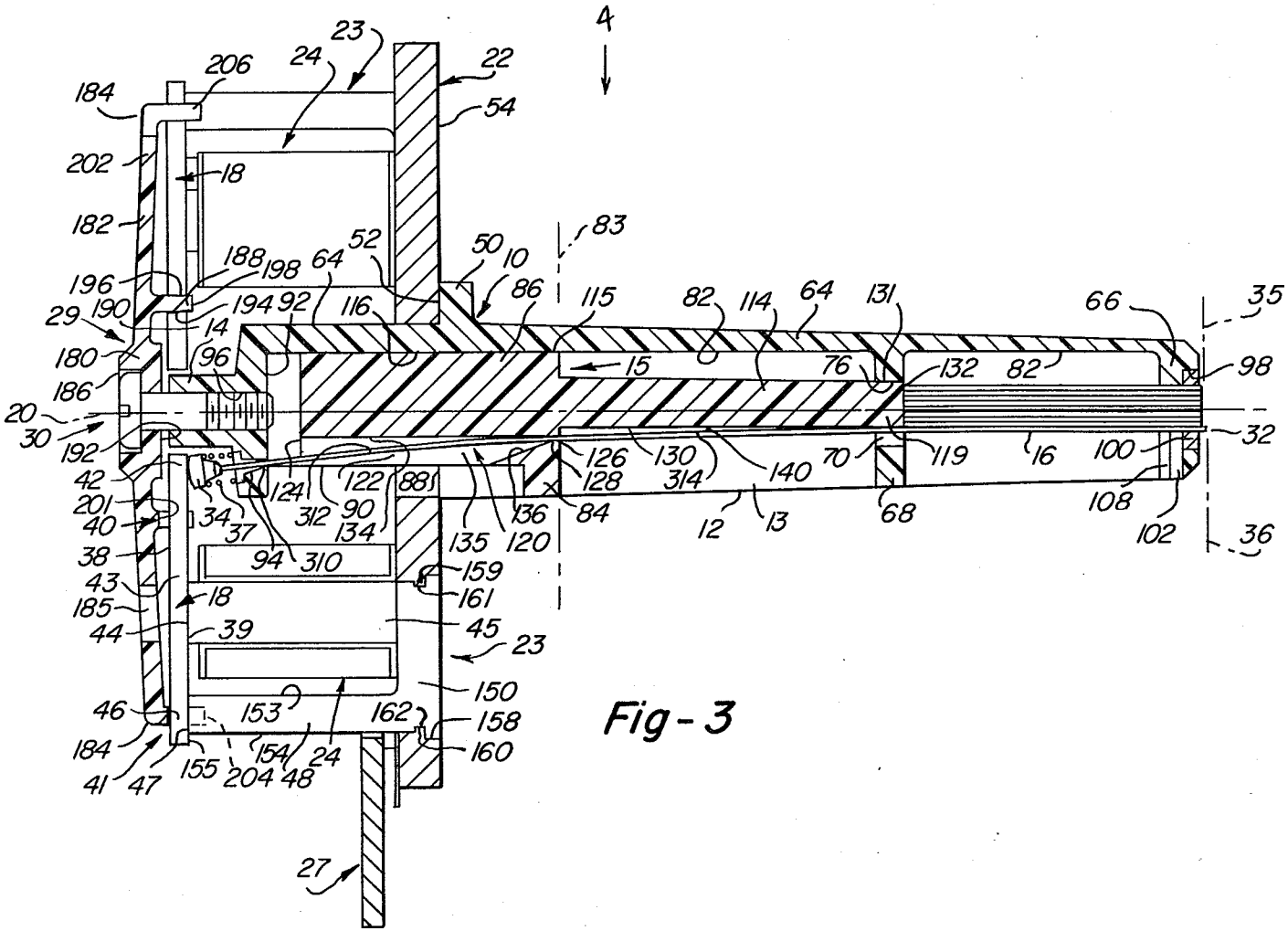
FIG. 3 is a longitudinal cross-sectional side elevational view of the assembly of FIG. 1 with parts removed.

In general, as shown in FIGS. 1 & 3, the print head apparatus comprises a wire housing means member 10 having an elongated wire stylus guide and support portion 12 defining an elongated cavity 13 with an annular hub portion 14 at one end and an elongated bearing and guide means member 15 therewithin for supporting a plurality of elongated wire stylus print members 16. An equal number of armature members 18 are mounted in a circular array in equal radially and circumferentially spaced relationship about a central longitudinal axis 20 on radial center lines 21. The print head apparatus further comprises electromagnetic actuating means in the form of metallic plate means 22 for supporting an equal number of armature actuating magnetic pole means 23 and electrical wire coil means 24 located in a circular array in equally radially and circumferentially spaced relationship about central axis 20 in juxtaposition to and operative relationship with the armature members 18. The metallic plate means 22 has a circular peripheral configuration and mounting plate hole means 25, 26 for fixed attachment of the print head assembly to a printer apparatus (not shown) by suitable fastening means (not shown). An electrical connector plate 27 is attached to plate 22 by suitable fastening means 28. An annular armature retaining cover plate means 29 is fastened to wire housing means member 10 by suitable threaded fastener means 30.

In the illustrative embodiments, there are nine wire styli print members 16 of conventional design each including a paper impacting end portion 32 and an impact head portion 34 as shown in FIG. 3. However, as is known in the art, the number of wire members may be varied, e.g. 7, 18, etc. The wire members 16 are slidably reciprocably movable a distance of approximately 0.015 inch between a retracted non-print position 35 and an extended print position 36. The wire members are normally located in the non-print position by associated compression spring members 37 and are movable to the print position by kinetic energy obtained from associated armature members 18.

There are nine armature members 18, having flat parallel oppositely facing side surfaces 38, 39, mounted in circumferentially spaced radially aligned radially innermost and radially outermost slot means 40, 41 between cover plate means 29 and magnetic pole means 23. A radially innermost armature drive head portion 42 of relatively narrow width is mounted in abutting engagement with the impact head portion 34 of the associated wire member 16. A tapered intermediate portion 43 of each armature member, located between slot means 40, 41, is engageable with the outer end surface 44 of the radially innermost pole portion 45 in the forwardly extended print position and spaced therefrom in the non-print position (not shown). An outer end armature portion 46 of relatively wide width is pivotally supported by and confined within slot means 41 by the outer end surface 47 of radially outermost pole portion 48. Thus, the construction and arrangement is such that each armature member is mounted in a manner permitting operative pivotal movement of the drive head portion 42 between the rearwardly retracted nonprint position, and the forwardly extended print position relative to the wire members 16 while also being confined in operative relationship with the impact head portion 34 and the electromagnetic means 23, 24. The housing means member 10 and bearing member 15 are preferably each made of one piece of relatively rigid molded polymeric materials such as a composite by weight of 30% carbon fibers, 13% polytetra fluoroethylene and 2% silicon with the remainder being nylon.

THE WIRE HOUSING MEANS

Figure 4:
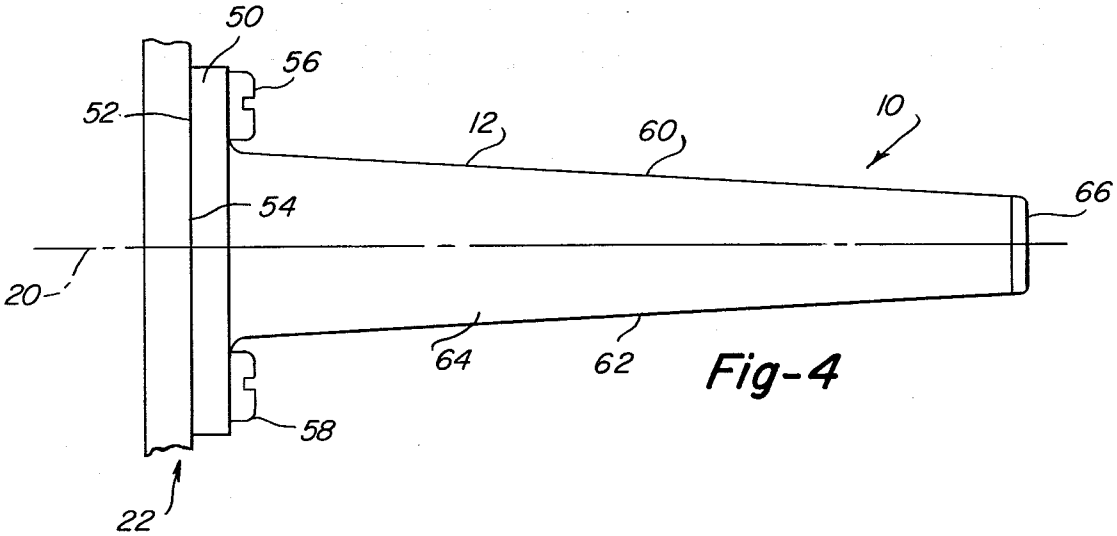
FIG. 4 is a side elevational view of a portion of the wire housing taken in the direction of arrow 4 in FIG. 3.
Figure 5:
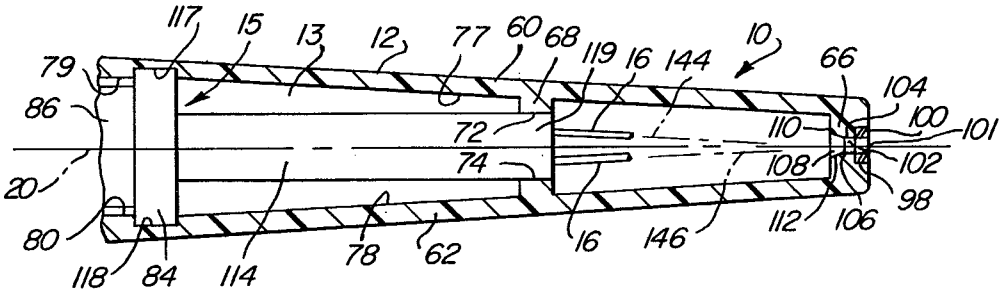
FIG. 5 is a cross-sectional view of a portion of the wire housing of FIGS. 3 & 4.

Referring to FIGS. 3–5, the housing means member 10 comprises a centrally located attachment flange portion 50 having a side surface 52 adapted to abut side surface 54 of plate member 22 and be secured thereon by suitable fastening devices 56, 58, FIG. 4. Housing portion 12 is of generally U-shape cross-sectional configuration defined by outwardly inwardly inclined side wall portions 60, 62 connected by a side wall portion 64, an end wall portion 66, and an intermediate wall portion 68 having a mounting slot 70 defined by parallel side surfaces 72, 74 connected by a transverse surface 76. The housing cavity 13 is defined by axially outermost outwardly inwardly inclined inner side surfaces 77, 78 and axially innermost parallel inner side surfaces 79, 80 of wall portions 60, 62; and inner surface 82 of wall portion 64 which is parallel to central axis 20. The axially innermost portion of cavity 13 beyond a plane 83 has a suitable cross-sectional configuration adapted to receive and releasably retain the bearing and guide means 15 which comprises a quadrilateral mounting flange portion 84 and an elongated cylindrical portion 86 having a central axis coaxial with central axis 20 as generally described in my prior U.S. patent application Ser. No. 885,186 by reference to member 52 therein. Side wall portions 60, 62 become parallel axially inwardly beyond plane 83 and are radially inwardly offset at 88 so as to have end surfaces 90 which are coplanar with the adjacent portion of the peripheral surface of cylindrical portion 86. Inner end wall portion 92 has circumferentially spaced tapered wire guide slot and spring mounting means 94 formed therein for each of the wire members 16. A threaded bore 96 extends through the hub portion to receive fastening device 30. The other outer end 66, FIG. 5, has a slot 98 to receive a wire bearing plate member 100 having wire openings 101, an intermediate wire guide slot 102 having flat parallel side walls 104, 106, and a tapered wire guide inlet slot 108 having inclined converging side walls 110, 112.

THE GUIDE & BEARING MEANS MEMBER

Referring now to FIGS. 3 & 5, the guide and bearing means member 15 comprises an elongated rearwardmost cylindrical portion 86, located next adjacent the side wall 92, and a forwardmost elongated generally rectangular grooved portion 114 extending axially outwardly toward the support flange 68. The member 15 is suitably fixedly mounted in the cavity 13 with the upper peripheral surface 115 of the cylindrical portion 86 engaging the adjacent portion of inner surface 116 of the wall portion 64 and the peripheral surfaces of the flange portion 84 engaging, respectively, the surface 116 and retaining slots 117, 118, FIG. 5, along the inner surfaces of the housing 10. The portion 114 is supported in forwardly extending cantilever fashion from flange portion 84 with the outer end portion 119 being mounted in slot 70 in support flange 68.

Separate circumferentially spaced wire guide and bearing means passages 120 are provided in the member 15 for each wire. Each passage comprises a first relatively long guide means passage portion 122 of generally triangular cross-sectional configuration which is gradually reduced in cross-sectional area between an inlet opening 124 and a circular outlet opening 126; a relatively short length bearing means passage portion 128 of uniform circular cross-section; and a relatively long length guide and bearing groove passage portion 130 of generally triangular cross-sectional configuration connected at one end to passage portion 128 and terminating at the other end in a relatively short length bearing means passage portion 131 and an outlet opening 132.

As described in my copending U.S. application Ser. No. 885,186, each wire guide means passage portion 122 comprises an elongated radially innermost arcuate guide surface 134 having a radius of curvature slightly larger than the radius of the wire members 16. The equally spaced centers of curvature are arranged in a generally elliptical pattern at varying radial distances from the central longitudinal axis 20. Guide surfaces 134 extend in parallel linear relationship with one another and the central longitudinal axis 20. Each passage portion 122 further comprises a pair of circumferentially spaced generally radially outwardly extending flat side surfaces 135 tangentially connected by curved inner surfaces 134 and an arcuate radially outermost surface 136 having a center of curvature along the central longitudinal axis 20. The circumferential and radial location as well as the cross-sectional areas of the passage portions may be varied as necessary or desirable to accommodate the number of wire members used in any particular embodiment.

Each bearing means passage portion 128 has an uniform circular cross-sectional configuration with a radius of curvature equal to and coaxial with the radius of curvature of the arcuate inner surfaces 134 of the guide means passage portions 122 so that the radially innermost surface portions of the circular passage portion 128 are coplanar with the arcuate inner surfaces 134 and arranged in the same generally eliptical pattern as the centers of curvature of surfaces 134. The diameters of bearing means passage portion 128 are slightly larger than the diameter of the wire members 16 to enable free sliding movement therethrough while providing confining circumferential bearing support therefor. In the illustrative embodiment for a wire diameter of 0.0142 inch, the diameter of bearing passage portion 128 is preferably 0.016 inch and the length is approximately 0.03 inch.

Each guide and bearing groove passage portion 130 comprises an elongated radially innermost arcuate guide surface 140 having a radius of curvature (the same as surfaces 134) slightly larger than the radius of the wire members 16 and a pair of outwardly diverging side surfaces extending tangentially from the arcuate inner surface 140. The cross-sectional configurations and locations of the groove passage portions 130 relative to the central longitudinal axis 20 are varied for the purpose of locating the print end portions of the wire members in a predetermined pattern in bearing passage portions 131 adjacent the outlet openings 132 whereat the centers of curvature of the arcuate inner surfaces 140 of the groove passage portions 130 are located in suitable coplanar relationship such as in two parallel planes 144, 146, FIG. 5, with five of the centers of curvature located in a first plane 144 on one side of and closely adjacent to the central axis 20, and four of the centers of curvature located in a second plane 146 on the other side of and closely adjacent to the central axis 20. The centers of curvature are equally laterally offset from one another in laterally staggered relationship with adjacent centers of curvature being located in relatively closely spaced lateral relationship.

The construction and arrangement is such that the wire members 16, FIG. 5, extend axially outwardly from openings 132 toward the tapered inlet slot 108 and the guide slot 102. In the assembled position, the end portions of the wire members extend through guide slot 102 into precision ground transversely aligned axially extending parallel wire bearing passages 101 in conventional bearing plate member 100 so that the ends of the wire members are thus arranged in a conventional manner in parallel closely spaced aligned relationship to one another and the central axis 20.

Each wire member 16 is assembled through the guide and bearing passage means 94 in the housing flange portion 92 prior to assembly of the armature members 18. The wire member print end portion 32 is simply inserted in the passage means 94 and the wire member is pushed axially outwardly in one continuous uninterrupted movement until the assembly movement is completed. As the print end portion leaves passage means 94, it is directed toward a central portion of the guide passage portion 122 in member 15 by the angle of inclination of passage means 94. After the print end portion enters the associated one of the passage portions 122, it is then moved along passage portion 122 into and through the first bearing passage portion 128; then along groove passage portion 130 into a second bearing passage portion 131 at the end of elongated grooved portion 114 then into engagement with one of the tapered side surfaces 110, 112 of the tapered inlet opening 108 which deflect the wire end portion into guide slot 102; and then through slot 102 into the associated one of the bearing openings 101 in plate 100. Since the passage means 120 are separated from one another throughout their lengths, the wire members may be inserted or withdrawn in any order without interference with any other wire member.

THE ELECTRO-MAGNETIC MEANS

Figure 6:
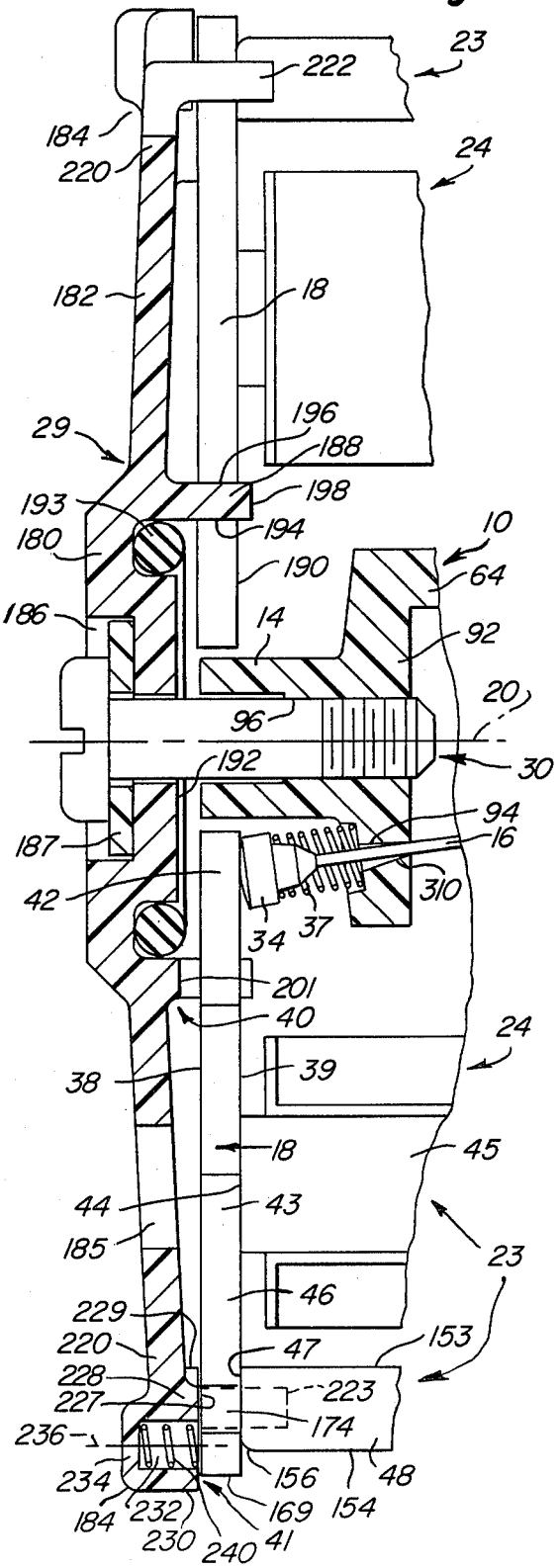
FIG. 6 is a cross-sectional view of a portion of another embodiment of a print head assembly of the present invention.

The plate means 22 and the pole means 23 are each preferably made of one piece of suitable metallic material with the plate means being made of a softer material than the pole means. In the presently preferred embodiment, the plate means is made of aluminum material and the pole means is made of silicon iron sintered powder material. Each of the pole means comprises an enlarged rectangular shape mounting base portion 150 with the radially innermost and outermost pole portions 45, 48 extending laterally outwardly therefrom. The innermost pole portion 45, which supports the coil member 26, has a circular cross-section with a flat circular outer end surface 44. The outermost pole portion 48 has a rectangular cross-sectional configuration with a flat rectangular outer end surface 47 defined by flat parallel side surfaces 151, 152 & 153, 154. An edge pivot surface 155, FIG. 3, or more preferably, a rounded pivot surface 156, FIGS. 6 & 8, is provided at the radially outermost edge of the outer end surface. Circumferentially spaced rectangular pole mounting openings 158, FIG. 3, of corresponding but slightly smaller shape than the pole base portions 150 are provided in plate means 22. Grooves 159, 160 are provided in base portion 150 so that as the enlarged pole base portion 150 is press fitted into the smaller size opening 158 it will cause metal deformation of the plate 22 forming rib portions 161, 162 locked in the retaining grooves 159, 160. In the assembled position, the enlarged pole base portion 150 completely fills the smaller size opening 158 with the side surfaces of base portion 150 being in intimate contact with the side surfaces of opening 158 to maintain uniform magnetic properties and with the end surface of base portion 150 being coplanar with side surface 54 of plate member 22 without any protuberances. After mounting of the pole portions, the pole end surfaces 44, 47 are ground so that the end surfaces of all pole portions are parallel and coplanar to provide fixed accurately located reference surfaces which are used to accurately locate the armatures 18 and the retainer cover plate means 29 as hereinafter described.

THE ARMATURES

Each armature member 18 comprises one piece of relatively thin rigid magnetic sheet metal material having flat parallel axially oppositely facing side surfaces 38, 39 which are ground to provide exact uniform thickness and parallalism. The relatively narrow width radially innermost drive head portion 42 has relatively closely spaced parallel side wall portions 163, 164, FIGS. 1 &7, extending parallel to radial center lines 21. The intermediate connecting portion 43 has inclined side wall portions, 165, 166 and the relatively wide radially outermost portion 46 has relatively widely spaced parallel side wall portions 167, 168 extending parallel to radial lines 21 and a transverse end wall portion 169. The spacing of side wall portions 167, 168 is sufficiently greater than the spacing of the adjacent side surfaces 151, 152 of the associated outer pole portions 48 so as to provide a substantial surface overlap. A pair of aligned rectangular slots 170, 172 are provided along side wall portions 167, 168 to define a reduced width armature portion 174 extending therebetween. Each of the slots 170, 172 are defined by parallel spaced side surfaces 175, 176 extending transversely relative to center line 21 and an inwardly offset end surface 178 extending parallel to center line 21. The length of slots 170, 172 is such as to locate end surfaces 178 a substantial distance inwardly of pole side surfaces 151, 152 whereby portions of pole end surface 47 are aligned with and accessible through each slot for a purpose to be described.

THE ARMATURE RETAINING COVER PLATE MEANS

The armature retaining cover plate means 29 is preferably made of one piece of rigid molded suitably polymeric material such as glass reinforced temperature resistant Nylon and comprises a central axially extending relatively thick rigid annular hub portion 180 and a relatively thin, slightly resiliently flexible, radially extending slightly axially inclined, annular flange portion 182 which is circumferentially continuously integrally connected to the hub portion 180. A plurality of generally radially extending, relatively thick rigid, retainer slot and locating means portions 184 are equally circumferentially spaced about the periphery thereof for abutting engagement with each outer pole surface 47 and for defining slot means 41 for receiving and confining each of the armature members 18. Circumferentially spaced access openings 185 may be provided in flange portion 182. The hub portion has a central annular bore 186 for receiving fastening means 30, which may be in the form of a self-threading selflocking screw member or the bore 96 may be threaded, and may preferably include an elastomeric ring member 187, or, preferably a metallic washer, FIGS. 6 & 8.

A radially innermost annular axially extending first inner rim portion 188 is radially outwardly spaced from and concentric with hub portion 180 to provide an annular cavity 190 therebetween in and adjacent to which are mounted the drive end portions 34 of the wire members 16 and the drive head portions 42 of armatures 18. A flat radially extending annular inner side surface 192 of hub portion 180 is located axially opposite the drive head portions 42 which, in the embodiment of FIGS. 1–3, provides armature locating means engageable with the drive head portions 42 in the retracted non-print position established by compression spring members 37 which bias the wire members 16 and the armature members 18 toward the retracted non-print position. In the embodiments of FIGS. 6 & 8, an annular elastomeric O-ring member 193 mounted in an annular groove 190*a*, FIG. 8, is used as the armature locating means and also a vibration dampening means to reduce armature vibration.

The rim portion 188 includes inner and outer axially extending annular side surfaces 194, 196 connected by a radially extending annular end surface 198, FIGS. 3, 6 & 8. Guide slot means 40 are formed in rim portion 188 by axially extending spaced parallel side surfaces 199, 200, FIG. 1, and a radially and circumferentially extending connecting surface 201, FIGS. 3, 6 & 8. Side surfaces 199, 200 are spaced apart a distance slightly greater, e.g. 0.002 to 0.004 inch, than the width of armature portion 42 for loosely guiding and confining the armature members during movement between the non-print and the print position.

The retainer slot and locating means portions 184 of the embodiment of FIGS. 1–3, each comprise a central radially outwardly extending flange portion 202 formed as a continuation of annular flange portion 182 and a pair of spaced axially extending abutment post flange portions 204, 206 at the corners which have an axial length such as to straddle and extend a substantial distance axially beyond the outer surface 47 of outer pole 48. The abutment post portions have oppositely facing parallel inner side surfaces 208, 210 and a transverse connecting surface 211 located opposite and parallel to outer pole surface 47 to define the slot means 41 which are centered on and extend transversely relative to the associated one of the radial center lines 21 of each armature. The cross-sectional area of abutment post portions 204, 206 are slightly smaller than the area of armature slots 170, 172 so as to be relatively loosely received in the armature slots with relatively small surface clearances of approximately 0.002 to 0.004 inch. The post portions 204, 206 have notches 212, 214, FIG. 2, to provide axially facing coplanar abutment surfaces means 215, 216 for rigid abutting supportive engagement with the portions of outer pole surface 47 opposite armature slots 170, 172, and to provide transverse oppositely facing parallel side surfaces 217, 218 for relatively loose abutting engagement with outer pole side surfaces 151, 152. Thus, in the assembled position, FIG. 2, the outer pole end surface 47 and slot surfaces 208, 210, 211 precisely define the slot means 41 which has a fixed rectangular configuration of fixed area corresponding to the rectangular cross-sectional configuration of the notched armature portion 174 while being relatively precisely dimensioned so as to provide a fixed cross-sectional area only slightly larger than the notched armature portion 174 sufficient to relatively closely confine the armature in slot means 41 while also enabling sufficient movement of the armature during operation. Furthermore, while the flange portion 182 is constructed and arranged to provide a limited amount of flexibility between hub portion 180 and the multiple circumferential spaced areas of abutment between post portions 204, 206 and outer poles 47 to enable limited axial adjustment of hub surface 192 by adjustment of fastening device 30 to control the air gap between the armature side surfaces 39 and inner pole end surface 44, the configuration of the slot means 41 and their relationship to the armature member 18 do not change. Thus, one advantage of such a construction and arrangement is to enable complete elimination of the use of separate resilient armature engaging means located in abutting engagement with one or more portions of the armature as has heretofore been accepted practice in the art.

In the alternative embodiment of FIGS. 6 & 7, the retainer slot and locating means portions 184 have been modified with the armature retaining cover plate means 29 otherwise being of the same general construction and arrangement as previously described including the alternative use of the resilient O-ring member 193 to locate and dampen the return movement of the armature members 18 to the non-print position. In this embodiment, the retainer slot and locating means portions 184 each comprise a radially outwardly extending flange portion 220 formed as a continuation of annular flange portion 182 and having a pair of spaced axially extending support post portions 222, 223 with oppositely facing parallel inner side surfaces 225, 226, FIG. 7, and a transverse connecting surface 227, FIG. 6, opposite outer pole end surface 47 to precisely define the slot means 41 as previously described. Inwardly facing notches (not shown) are provided in support post portions 222, 223 as previously described to abut the outer pole end surface 47 and loosely abuttingly engage the side surfaces 151, 152 of the outer pole 48. Thus, the notched portion 174 of the armature is movably confined within the slot means 41 as previously described. In addition, as shown in FIG. 6, a radially outer most portion 228 of flange portion 220, between an inner surface 229 and outer peripheral surface 230, is made more rigid than flange portion 182 by increasing the thickness of the material. The outer surface 230 is located radially outwardly beyond the radially outermost armature end surface 169 and surface 227 extends along a substantial length of the armature end portion between surfaces 229, 230. An annular axially extending spring mounting cavity 232 is provided in an annular housing portion 234 adjacent the radially outermost end of flange portion 220 in radial alignment with armature center lines 21 and having a central axis 236 which intersects the area of armature pivot on the rounded outer edge pivot surface 156 of the outer pole 48. A compression spring means 240 is mounted in cavity 232 in biasing engagement with the armature side surface 38 opposite the pole pivot surface 156 to continuously lightly hold the opposite armature surface 39 on the pivot surface 155 without exerting any substantial moment of force as has been prior art practice. In this manner, operating noise and wear may be minimized.

Figure 9:
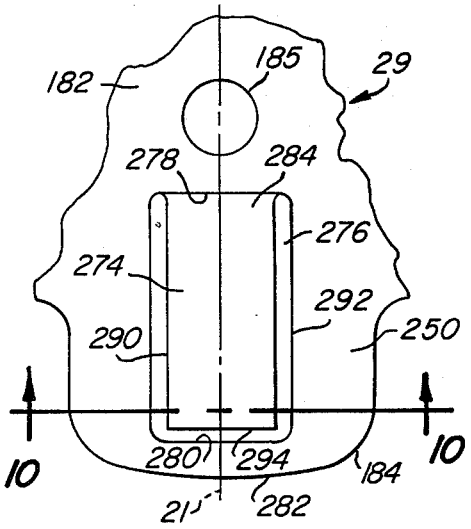
FIG. 9 is a partial end view of the assembly of FIG. 8.
Figure 10:
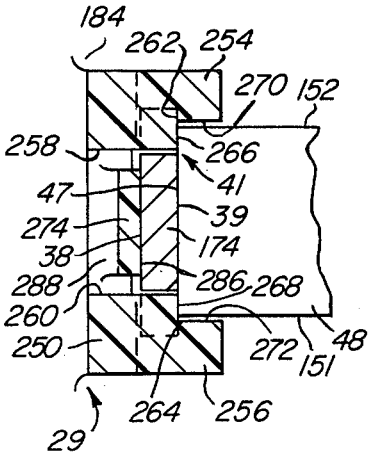
FIG. 10 is a partial cross-sectional view taken along 10—10 in FIG. 9.

Another embodiment of the retainer slot and locating means portions 184, which are equally circumferentially spaced about the periphery of the prior described armature retaining cover plate means 29, as shown in FIGS. 8-10, comprises a radially outwardly extending flange portion 250 formed as a continuation of annular flange portion 182 and having a pair of spaced axially extending support post portions 254, 256, FIG. 10, with oppositely facing parallel inner side surfaces 258, 260. Seating and support means are provided on support flange portions 254, 256 by inwardly facing notches 262, 264 having transverse coplanar abutment surfaces 266, 268 adapted to be abuttingly seated against the outer pole end surface 47 and oppositely facing parallel axially extending abutment surfaces 270, 272 adapted to loosely abuttingly engage the side surfaces 151, 152 of the outer pole 48. The notched armature portion 174 is received between surfaces 258, 260 as previously described. A relatively resilient radially outwardly extending armature engaging tongue means 274 is integrally formed in a rectangular radially extending opening 276 in cover plate means 29 along radial center lines 21 for defining each confining slot means 40 and for applying resilient spring-like force to the armature. A radially innermost side surface 278 of the opening 276 is located in the main flange portion 182 adjacent access opening 185 and the radially outermost side surface 280 is located in the flange portion 250 adjacent the outer side surface 282 thereof. The tongue means 274 has rectangular peripheral and cross-sectional configurations defined by an integral hinge portion 284 along opening wall 278, flat inner and outer axially spaced side surfaces 286, 288, and parallel circumferentially spaced side surfaces 290, 292, connected by a transverse end surface 294. As shown in FIG. 8, the tongue portion 274 is axially inwardly inclined from hinge portion 284 toward the outer pole pivot surface 156 and terminates in opposite axially spaced relationship therewith to define the armature slot means 41 while also enabling resilient biasing engagement of the outer end portion of tongue surface 286 with the adjacent armature side surface 38 opposite the pole pivot surface 156 along a center line 295 to eliminate any substantial moment of force on armature 18. In the presently preferred embodiment, the construction and arrangement is such as to provide a relatively low spring rate of approximately 15 lbs. per inch of deflection along the elongated rectangular area of engagement between tongue portion 274 and the armature side surface 38 sufficient only to lightly hold the armature surface 39 in contact with pivot surface 156. The width of tongue portion 274 between side surfaces 290, 292 is approximately 75% of the width of the notched portion of the armature as illustrated in FIG. 10. A radially outermost portion 296 of flange portion 250, between an inner surface 298 and outer peripheral surface 282, is made more rigid than flange portion 182 by increasing the thickness of the material. The outer surface 282 is located radially outwardly beyond the radially outermost armature end surface 169 and surfaces 266, 268 extend along a substantial length of the armature end portion between surfaces 282 & 298. A second vibration dampening spring means is provided by engagement at 300, upon movement of the armature beyond the print position, between side surfaces 266, 268 of the radially outermost portion 296 of flange portion 250 and the adjacent radially outermost edge portion of the armature defined by the intersection of armature surfaces 38 and 169, the presently preferred construction and arrangement being such as to provide a spring rate of approximately 50 lbs. per inch of deflection.

ASSEMBLY & OPERATION

In the assembled position, the drive end portion of each wire member extends in a straight unflexed condition from the drive head 34 through tapered passage 94 and is freely slidably supported and circumferentially confined by a relatively short length reduced diameter first bearing means passage portion 310, FIGS. 3, 6 & 8, having a diameter slightly larger than the wire diameter (e.g., 0.016 inch diameter for a 0.0142 inch wire diameter). As shown in FIG. 3, a first innermost intermediate wire portion 312 between the outlet opening of bearing means 310 and the inlet opening of bearing meahs passage portion 128 is mounted in a flexed bowed condition in passage portion 122 in complete circumferentially spaced relationship to the side surfaces thereof. A relatively short length portion of the wire member is freely slidably supported and fully circumferentially confined by the reduced diameter second bearing means passage portion 128 which has a diameter slightly greater than the wire diameter. A second outermost intermediate wire portion 314 between bearing passage portion 128 and bearing passage portion 131 is supported in a much lesser flexed bowed condition in the first part of groove passage portion 130 between the outlet opening 126 of bearing means passage portion 128 and the inlet opening to bearing means passage portion 131 in circumferentially spaced relationship to the side surfaces of the groove passages 130. A relatively short length of the wire member is freely slidably supported and fully circumferentially confined by the third bearing means passage portion 131 which has a semi-circular cross-sectional configuration slightly larger than the wire diameter. The intermediate portions of the wire members between the outlet openings 132 of bearing passage portions 131 and the inlet openings of bearing passage portions 101 are only very slightly inwardly flexed to change the wire member pattern from that of two parallel laterally offset rows of coplanar groups of staggered wire members to one row of coplanar aligned closely adjacent wire members. A relatively short length portion of each wire member is freely slidably supported and very closely circumferentially confined in bearing means passage portion 101 which has a diameter only very slightly greater than the wire diameter (e.g., $0.0145 \pm 0.0002$ inch diameter for a 0.0142 inch diameter wire). After the wire members have been assembled, the end surfaces of the print end portions are ground to provide exact alignment.

Thus, each wire member is supported during reciprocable movement in use by four relatively short length bearing means passage portions 310, 128, 132, 101, the axial spacing and length of each set of bearing means for each wire being substantially uniform and the axial spacing between adjacent pairs of passage portions being substantially equal whereby approximately three equal lengths of the wire member extend between the outlet opening of bearing passage 310 and the inlet opening of bearing passage 128, between the outlet opening 126 of bearing passage 128 and the inlet opening of bearing passage 131, and between the outlet opening 132 of bearing passage 131 and the inlet opening of bearing passage 101.

In the assembled position, the portion of the armatures extending radially inwardly beyond the pole pivot means 155, FIG. 3, or 156, FIGS. 6 & 8, provided by the outer most edge surfaces of the radially outermost pole portions 48 is of maximum radial length, e.g. approximately 0.80 inches, and the portion of the armatures extending radially outwardly beyond the pole pivot means is of minimum radial length, e.g. approximately 0.03 inch so that the arcuate length of pivotal displacement of the radially innermost armature end portion 42 is maximized while that of the radially outermost armature end portions adjacent slot means 41 is of minimum distance.

When the coil members 24 are energized, magnetic force is effective on the armature portions opposite inner pole portions 45 to pivotally move the armatures toward the inner pole end surfaces 44 by pivotal movement about pivotal means 155 or 156 until the side surfaces 39 of the armatures become parallel with the end surfaces 44, 47 of the pole portions. When the coil members 24 have been de-energized, the compression springs 37 associated with the wire members 16 and the rebound force of the sheets of paper impacted by the wire members combine to return the armature members and the wire members to the non-print position. Overtravel of the radial innermost armature portions 42 during the return movement is limited by surface 192, FIG. 3, or the resilient O-ring members 193 of FIGS. 6 & 8. The single center connection provided by the threaded fastening means 30 between two relatively rigid accurately located parts, ie. the wire housing means 10 and the pole means 23 which are fixed to plate means 22, enables very fine accurate adjustment of the air gap between the armature members and the pole portions.

In each of the embodiments of FIGS. 1–5, 6 & 7 and 8–10, the armature retainer cover plate means 29 is made of one piece of relatively inexpensive molded plastic material. The radially outermost slot and abutment means portions 184 have circumferentially spaced coplanar abutment surfaces 215, 216, & 266, 288 engaging the outer end surfaces 47 of the outer pole portions 48 to define armature confining slots 41 which are very accurately dimensioned and located. Thus, minimum spacing, e.g. 0.002 inch, between slot surfaces and armature surfaces therewithin may be maintained without impeding rapid pivotal movement of the armatures between the non-print position and the print position while reducing armature pivot wear and increasing stability due to more accurate and uniform location of the armature pivots. In addition, after seating of the abutment surfaces of the outermost slot and abutment means 184 on the outer surfaces 47 of the outer pole portions 48, the single centrally located adjustable fastening means 30 may be adjusted to variably uniformly locate the relatively rigid central hub portion 180 by resilient deflection of the intermediate flange portion 182 without changing the location or size of the outermost slot means 41.

If it is desirable or necessary to reduce vibration and resulting noise and wear of the embodiment of FIGS. 1–3, the resilient cushion means 193 and/or biasing spring means 240 or 274 & 296 of the embodiments of FIGS. 6 & 7 and 8–10 may be utilized. In the apparatus of the embodiments of FIGS. 6 & 7 and 8–10, the O-ring 193 is engageable with the radially innermost armature end portions 42 radially outwardly of the area of engagement with wire drive head 34. The axial location of the O-ring may be uniformly adjusted by adjustment of fastener means 30 to uniformly vary the armature air gaps relative to the innermost pole outer surface 44.

In the apparatus of the embodiment of FIGS. 6 & 7, separate spring means 240 may be employed to continuously lightly resiliently hold the armature portions 174 on the pivotal surface 156 of the outer pole portion. The relatively light spring force is applied directly opposite the pivotal surface 156 so as to eliminate any significant moment of force on the radially outermost end portion of the armature beyond the pivot which would tend to cause pivotal movement of the armature toward the non-print position in opposition to movement toward the print position. Overtravel of the armature beyond the print position, limited by engagement of the radially outermost armature edge portion beyond pivot 156 with the overlapping portion of surface 227 which applies a relatively high spring force to the armature to limit overtravel without adversely interfering with the movement from the non-print position to the print position.

In operation of the apparatus of the embodiment of FIGS. 8–10, the relatively flexible holding means 274 is constructed and arranged to continuously apply a relatively low biasing force of approximately 0.3 lbs. along a relatively long length and relatively narrow width transverse surface area of the armature located directly opposite the pivot area 156 on the outer pole 48. Again, engagement of the radially outermost edge portion of the armature with surface 286 limits over travel of the armatures by application of a relatively strong spring force after completion of the printing operation.

In this manner, vibration and resulting wear may be significantly reduced while maintaining maximum frequency response with minimum retardation of armature movement as compared with prior art apparatus such as my prior U.S. Pat. No. 3,929,214. The spring means provided by surfaces 227 & 286 of flange portions 228 & 296 are constructed and arranged to have a relatively high spring rate and to apply a relatively high biasing force along a relatively long length and relatively narrow width surface area of the armature located a relatively short distance radially outwardly of the pivotal pole surface 156. In this manner, the movement of the armature beyond the print position is effectively controlled by engagement between the outer edge of the rigid armature surface 38 and the relatively rigid abutment surfaces 227 or 286 which also serves to protect the relatively flexible tongue portion 274 from excessive load and wear to which it would otherwise be subjected. Thus, the combination of the amount of applied spring force, the location of application of the spring force, and the different spring rates of 15 lbs. and 50 lbs., respectively, of this invention is effective to enable the use of heavier and more magnetically efficient armatures which are capable of responding at significantly higher frequency than prior art apparatus such as disclosed in my prior U.S. Pat. No. 3,929,214, for example.

In addition to the aforedescribed armature holding and spring means, other types of armature holding and/or spring means may be employed. For example, in the embodiment of FIGS. 1–3, a holding rib or V-shape or semi-circular shape cross-section may be provided on surface 211 opposite pivot 155 to continuously hold the armature on the pivot to reduce noise, vibration and wear. Thus it is contemplated that the illustrative and presently preferred embodiments of the invention may be variously modified and otherwise constructed, and it is intended that the following claims be construed to include alternative embodiments except insofar as limited by the prior art.

What is claimed is:

1. A wire matrix print head assembly comprising:

a plurality of elongated printing wire members having print end portions and actuating end portions and being movable between a print position and a non-print position;

an elongated wire housing means having a central axis and a print end portion and an actuating end portion for supporting said wire members about said central axis for movement between the non-print position and the print position;

a rigid metallic plate means having a central opening for receiving and rigidly fixedly supporting an intermediate portion of said wire housing means;

a plurality of electromagnetic means for causing individual actuation of said printing wire members and being rigidly fixedly mounted on said metallic plate means in circumferentially spaced relationship in a circular array in radially outwardly spaced relationship to said elongated wire housing means;

each electromagnetic means comprising a radially innermost pole portion having an axially facing outer end surface and a radially outermost pole portion having axially facing outer end surface and the pole portions extending axially from said metallic plate means toward said actuating end portion of said elongated wire housing means, and further comprising an electrical coil device operatively associated with said radially innermost pole portion;

a plurality of armature members being located axially outwardly of an operatively associated with said electromagnetic means and said printing wire members for causing operation of said printing wire members by pivotal movement about an edge of one of the pole portions toward the axially facing outer end surface of the other one of the pole portions and being mpunted in a circular array in radially extending circumferentially spaced relationship; each armature member being radially aligned with and extending between one of said electromagnetic means and the actuating end portion of one of said elongated printing wire members;

an armature retainer plate means being centrally rigidly adjustably connected to said actuating end portion of said elongated wire housing means and having a radially outwardly extending flange portion located axially adjacent and in juxtaposition to said armature members and being rigidly supported by said electromagnetic means for retaining said armature members in operative association with said actuating end portions of said elongated wire members and said electromagnetic means;

said retainer plate means comprising:

a circumferentially continuous substantially rigid solid annular center portion;

a circumferentially continuous relatively rigid solid intermediate annular flange portion intergral with and extending radially outwardly from said center portion and being resiliently deflectable relative thereto;

a plurality of circumferentially spaced individual flange portions located on the outer periphery of and integral with and extending radially outwardly from said intermediate annular flange portion, there being one of such individual flange portions located in alignment with and juxtaposition to each of said outer pole portions;

support surface means on each of said individual flange portions being abuttingly engageable with the outer end surface of the associated outer pole portion for fixedly axially locating said individual flange portions relative to the associated outer pole portion;

a plurality of armature retaining slot means arranged and located on the outer periphery of said armature retainer plate means in a circular array for receiving and retaining radially outermost portions of said armature members in operative relationship with the associated electromagnetic means without applying any moment of force to said armature members tending to cause pivotal movement away from the axially facing outer end surface of the other one of the pole portions; and said armature retaining slot means being located adjacent said support surface means and being defined by a pair of circumferentially spaced parallel side surfaces and a transverse connecting surface extending between said side surfaces and said outer end surface of said outer pole portion for receiving a radially outermost portion of the associated armature member and confining the associated armature member during pivotal movement between the non-print position and the print position.

2. The invention as defined in claim 1 and wherein:

each of said armature members being pivotally supported on the radially outermost edge of said outermost pole portion of the associated one of said electromagnetic means.

3. The invention as defined in claim 2 and wherein:

the axial distance between the outer end surface of each the transverse connecting surfaces of said armature retaining slot means and the associated pole portion being sufficiently larger than the thickness of the associated one of said armature members to prevent contact between axially facing side surfaces thereof during movement between the non-print position and the print position.

4. The invention as defined in claim 3 and further comprising:

a radially innermost armature slot means on the side of said radially extending flange portion of said retainer plate means facing said actuating end portion of said elongated wire housing means located radially adjacent each of said actuating end portions of said elongated printing wire members for guidably receiving and laterally confining the associated one of said armature members without contact being made with axially facing side surfaces thereof during movement between the non-print position and the print position.

5. The invention as defined in claim 4 and wherein each of said radially innermost armature slot means comprising:

a pair of circumferentially spaced side surfaces extending axially from the radially extending flange portion of said retaining plate means toward said armature member and having a circumferentially extending side surface therebetween defining a slot receiving an intermediate portion of said armature member therewithin.

6. The invention as defined in claim 5 and wherein said radially innermost armature slot means further comprising:

an annular rim portion on said radially extending flange portion of said retaining plate means, each slot being formed in said annular rim portion.

7. The invention as defined in claim 3 and further comprising:

adjustable fastening means connecting said retainer plate means to said actuating end portion of said elongated wire housing means for enabling simultaneous equal adjustment of the air gap between each armature member and the associated one of said electromagnetic means without changing the location of said armature retaining slot means relative to said outermost pole portions of said electromagnetic means.

8. The invention as defined in claim 1 and wherein:

said individual flange portions being axially fixed relative to said outer pole portions and said center portion being axially displaceable relative to said individual flange portions by resilient deflection of said intermediate flange portion relative to said individual flange portions to vary the width of the air gap between the armature and the innermost pole portion.

9. The invention as defined in claim 8 and further comprising:

adjustable fastening means for connecting said center portion to said wire housing means for adjustably varying the axial location of said center portion relative to said individual flange portions.

10. The invention as defined in claim 1 and further comprising:

spring means mounted on each of said individual flange portions and being continuously engageable with the associated armature member directly opposite said pivotal surface for continuously applying a relatively light spring force on the armature member to maintain the armature member in constant pivotal engagement with said pivotal surface during movement between the nonprint position and the print position.

11. The invention as defined in claim 10 and further comprising:

additional spring means provided on each of said individual flange portions for engagement with and application of a relatively large spring force to the associated armature member radially outwardly of said pivotal surface only during movement beyond the print position to limit overtravel of the armature member beyond the print position.

12. The invention as defined in claim 11 and further comprising:

cushion and locating means mounted on said central portion for resilient locating engagement with each of the armature members radially outwardly of and adjacent to the area of engagement of the radially innermost portions of said armature members with said wire members for locating said armature members in the non-print position and for resiliently restraining movement of said armature members beyond said non-print position.

13. The invention as defined in claim 12 and further comprising:

a second slot means for each armature member in said intermediate flange portion and located in radially outwardly spaced juxtaposition to said central portion for confining and limiting lateral displacement of said armature members during pivotal movement between said non-print position and said print position.

14. The invention as defined in claim 11 and wherein said spring means comprising:

a compression spring means mounted in a spring cavity formed in said individual flange portions.

15. The invention as defined in claim 11 and wherein said spring means comprising:

a resilient integral flap means connected to said intermediate flange portion and located in a separating slot means formed in said individual flange portions.

16. The invention as defined in claims 14 or 15 and wherein said additional spring means comprising:

a radially extending abutment surface on the radially outermost end portion of said individual flange portions and overlapping and being engageable with the radially outermost edge portion of said armature member radially outwardly beyond said pivotal surface.

17. The invention as defined in claim 1 and wherein:

each of said electromagnetic means further comprising a one piece member made of harder material than said rigid metallic plate means and having an enlarged base portion of polygonal configuration integrally connecting said radially innermost pole portion and said radially outermost pole portion; and a plurality of polygonal openings in said rigid metallic plate means of smaller corresponding size than said enlarged base portion and each of said openings frictionally receiving and retaining said enlarged base portion of an associated one of said electromagnetic means with the side surfaces of each of said openings being in intimate contact with the side surfaces of said enlarged base portion of the associated one of said electromagnetic means.

18. The invention as defined in claim 17 and further comprising:

groove means provided on opposite side surfaces of said enlarged base portion of each of said electromagnetic means for receiving metal displaced from said rigid metallic plate means during insertion of said enlarged base portion of each of said electromagnetic means into the associated one of said openings and forming integral rib means in the side wall portions of said openings which are located in said groove means for fixedly retaining said electromagnetic means on said plate means.

19. The invention as defined in claim 18 and wherein:

said enlarged base portion of each of said electromagnetic means having a flat end surface which is coplanar with the adjacent side surface of said rigid metallic plate means.

20. The invention as defined in any of claims 1 or 4 or 7 or 11 or 12 and wherein:

each of said armature retaining slot means defining a slot of substantially non-variable cross-sectional area of a size and shape slightly larger than and corresponding to the size and shape of the radially outermost portions of said armature members received therewithin, each slot being defined by the end surface of said radially outermost pole portion and radially and axially extending non-movable surfaces on said aramture retainer plate means with each of the surfaces defining said armature retaining slot means being spaced from the surfaces of the radially outermost portions of said armature members received therewithin a distance sufficient to enable operative movement of said armature members without contact therebetween; and holding means on said armature retainer plate means located in juxtaposiition to each of said armature retaining slot means and being continuously engageable with said radially outermost portion of each of said armature members at a location opposite the radially outermost edge of said outermost pole portion of the associated one of said electromagnetic means for holding said radially outermost portion of each of said armature members in pivotal relationship with the radially outermost edge of said outermost pole portion without applying any moment of force thereto tending to cause rotation of the associate armature member away from said axially facing outer end surface of said radially innermost pole portion.

* * * * *